US005622601A

United States Patent [19]

Adams et al.

[11] Patent Number: 5,622,601

[45] Date of Patent: Apr. 22, 1997

[54] METHOD AND APPARATUS FOR EFFECTING A CLIPPED TAIL IN A TRAVELING PAPER WEB

[75] Inventors: Richard J. Adams, Rockton, Ill.; Edward L. Brossard, Janesville, Wis.; Curtiss R. Dahl, Roscoe, Ill.; Timothy E. Lee; Mark A. Sorenson, both of Beloit, Wis.

[73] Assignee: Beloit Technologies, Inc., Wilmington, Del.

[21] Appl. No.: 530,935

[22] Filed: Sep. 19, 1995

[51] Int. Cl.[6] ..... D21F 7/00

[52] U.S. Cl. ..... 162/194; 162/193; 162/195; 162/255; 162/286; 83/53; 83/177

[58] Field of Search ..... 162/193, 194, 162/195, 255, 286; 83/53, 177

[56] References Cited

U.S. PATENT DOCUMENTS

| | | | |
|---|---|---|---|
| Re. 34,645 | 6/1994 | Rooney | 83/150 |
| 3,556,936 | 1/1971 | Miyamoto | 162/286 |
| 3,625,813 | 12/1971 | Eckelman | 162/286 |
| 3,891,157 | 6/1975 | Justus | 242/56 |
| 4,136,808 | 1/1979 | Reba | 162/193 |
| 4,182,170 | 1/1980 | Grupp | 162/286 |
| 4,611,518 | 9/1986 | Hildebrandt | 83/105 |
| 4,648,942 | 3/1987 | Wanke et al. | 162/286 |
| 4,671,151 | 6/1987 | Rooney | 83/150 |
| 4,695,004 | 9/1987 | Grossmann et al. | 242/56 |
| 4,818,343 | 4/1989 | Laine | 162/86 |
| 4,904,344 | 2/1990 | Peiffer | 162/193 |
| 4,931,140 | 6/1990 | Peltola et al. | 162/193 |
| 5,281,308 | 1/1994 | Lauterbach | 162/306 |
| 5,423,947 | 6/1995 | Steiner et al. | 162/286 |

*Primary Examiner*—Karen M. Hastings
*Attorney, Agent, or Firm*—Dirk J. Veneman; Raymond W. Campbell; Gerald A. Mathews

[57] ABSTRACT

A clipped tail, which is the severed lead end of a paper web tail formed on a papermaking machine, is produced in the tail supported on a roll by combining the operation of a water jet, which projects a high pressure stream of water and is moved laterally to sever the tail transversely to its direction of travel, with the operation of a doctor having a blade, which moves with the water jet and which lifts and deflects the tail clip and following tail from the roll. An air stream is used to guide the tail downstream of the doctor blade. Both the water jet and doctors are mounted on a traversing apparatus to move transversely together across the traveling tail to automatically produce the tail clip and direct it to thread the downstream portion of the papermaking machine.

10 Claims, 3 Drawing Sheets

METHOD AND APPARATUS FOR EFFECTING A CLIPPED TAIL IN A TRAVELING PAPER WEB

BACKGROUND OF THE INVENTION

1. Field of the Invention

This invention relates to the creation of a clipped tail in a traveling web, such as the paper web produced on a papermaking machine. A tail clip is a device which cuts in a traveling web tail which severs, or clips, the tail laterally, so as to produce a free end of the traveling tail which can be lifted, deflected and directed into a desired location in the papermaking machinery for further processing of the web. When the clipped tail has been threaded through the entire papermaking machine, the tail can be widened to the desired full width of the web, to produce the paper product.

2. Description of the Prior Art

A clipped tail has been produced, after a fashion, by manually intercepting the traveling web, or tail, and tearing it to produce an end which is then directed by a metal wand, or a hand-held air pipe, into the downstream machinery. Methods and apparatus for mechanically producing or handling tails and clipped tails in a traveling paper web, such as produced on a papermaking machine, are also known. Some examples are shown and described in the following U.S. Pat. Nos. 4,904,344 (Peiffer); U.S. Pat. No. 4,136,808 (Reba); U.S. Pat. No. 3,625,813 (Eckelman); U.S. Pat. No. 4,671,151 (Rooney) U.S. Pat. No. 4,611,518 (Hildebrandt).

Heretofore, a clipped tail has been produced by positioning a pivotable doctor blade over a paper web tail as the tail is supported on the surface of a rotating roll. The doctor is pivoted against the paper web tail, to sever the tail by pinching the web between the doctor blade and the supporting surface beneath the web. This method works on lightweight paper grades, but is not reliable on heavier, paperboard grades.

Also known is the use of a high-pressure water jet for laterally cutting a traveling paper web tail as it travels while supported on the surface of a rotating roll. This procedure requires that the tail be removed from the roll surface by a blast of high pressure air, which is poor at directing the tail in a downstream direction.

Both of these tail clipping procedures produce a clipped tail, but are not adept at coordinating the production of the clipped tail with the transfer of the on-coming tail into downstream operations in the papermaking machine. The use of a directed stream of air, sometimes in association with a doctor or air pan arrangement is also known to convey a tail downstream.

Other problems relate to the lack of consistency in producing the clipped tail, due to the fact that the apparatus was positioned and loaded against the support surface, typically the surface of a rotating roll, by hand. Thus, where a doctor blade was positioned over the traveling tail and loaded against the tail by hand to clip the tail, frequently too great or too little pressure was applied by the doctor blade against the traveling tail, so as to either not sever the tail, or to crepe the newly severed tail, or to increase the wear of either or both the doctor blade or the surface of the rotating support roll. Further, some operators were more adept at effecting the clipped tail than others, and, regardless of what inefficiencies or problems occurred while producing the clipped tail, valuable production time was lost in threading the papermaking machine, so as to bring it up to full papermaking capacity. In addition, the close proximity of the operator to the machinery to effect the clipped tail and subsequent threading of the clipped tail represented a safety hazard.

The concepts of cross-cutting the paper tail with a high-pressure water jet, and engaging the paper web tail with a doctor blade have been combined previously, but such combinations have also heretofore been manually operated and controlled. Therefore, while additional reliability was made possible for producing the clipped tail, the total procedure took a relatively long time, and was still dependent on the skill of the individual operator to coordinate the separate tail clipping and tail directing functions, and sometimes took more than one operator. In a paper mill which runs 24 hours a day, such inefficiencies in the skill and number of operators and the apparatus resulted in inefficiencies in the transfer of the tail between sections of the papermaking machine, which, in turn, affected the overall economy of the paper production process.

SUMMARY OF THE INVENTION

The inefficiencies and shortcomings of prior, manually operated, tail clip procedures and apparatus have been obviated by this invention. A high-pressure water jet is mounted with a doctor blade on a transport apparatus to move laterally (i.e. transversely) of the paper web tail with the doctor blade. Both the water jet and the doctor blade are initially positioned outboard of the traveling tail at a location where the tail is supported on the rotating surface of a roll, such as a calender roll. The leading edge of the doctor blade is brought into engagement with the surface of the support roll with a uniform, controlled pressure. When the water jet is activated to project a web-severing stream of water, the transport apparatus is moved transversely of the tail to produce a clipped tail (i.e. a severed end of the on-coming web tail) as well as to simultaneously pick up and remove the on-coming web tail from the surface of the rotating support roll by scraping, or doctoring, the web from the roll surface with the doctor blade, and maintaining the doctor blade interposed between the roll surface and the tail until the tail has been guided into the next, downstream, apparatus and the slack in the tail is taken up to make the tail desirably taut. At this time, the water jet and doctor are deactivated and the transport apparatus is withdrawn to a ready position outboard of the traveling web tail.

The entire operation of producing the clipped tail, removing the on-coming tail from the surface of the support roll, and conveying the newly-formed end of the tail into downstream equipment, such as the reel on a papermaking machine, is all done automatically under a single control. The water jet and doctor blade cooperate to both produce an initial string-like, secondary tail in the on-coming tail and to simultaneously remove the secondary tail, as well as the subsequently formed full-width tail, from the surface of the support roll. The creation of the string-like secondary tail is actually the beginning of the tail clipping function, as the water jet and doctor blade laterally traverse the surface of the support roll. The entire procedure can be controlled remotely by a single operator from a control panel, thereby providing consistency in effecting the clipped tail, speed and safety.

The tail clip is the apparatus for producing the clipped tail.

Accordingly, it is an object of this invention to provide an improved web tail clip and tail transfer apparatus for use on a papermaking machine.

Another object of this invention is to provide an automatic method and apparatus for effecting the web tail clip and tail transfer on a papermaking machine.

A feature of this invention is the coordination of the operation of both a water jet and doctor blade in effecting the web tail clip and the tail transfer on a papermaking machine.

Another feature of the invention is the creation of the web tail clip and removal of the on-coming tail from its support surface, such as a roll, without the use of an air stream to physically remove the tail from the support surface.

These, and other objects, features and advantages of the invention will become readily apparent to those skilled in the art upon reading the description of the preferred embodiment in conjunction with the attached drawings.

IN THE DRAWINGS

DESCRIPTION OF THE PREFERRED EMBODIMENT

Figure 1:
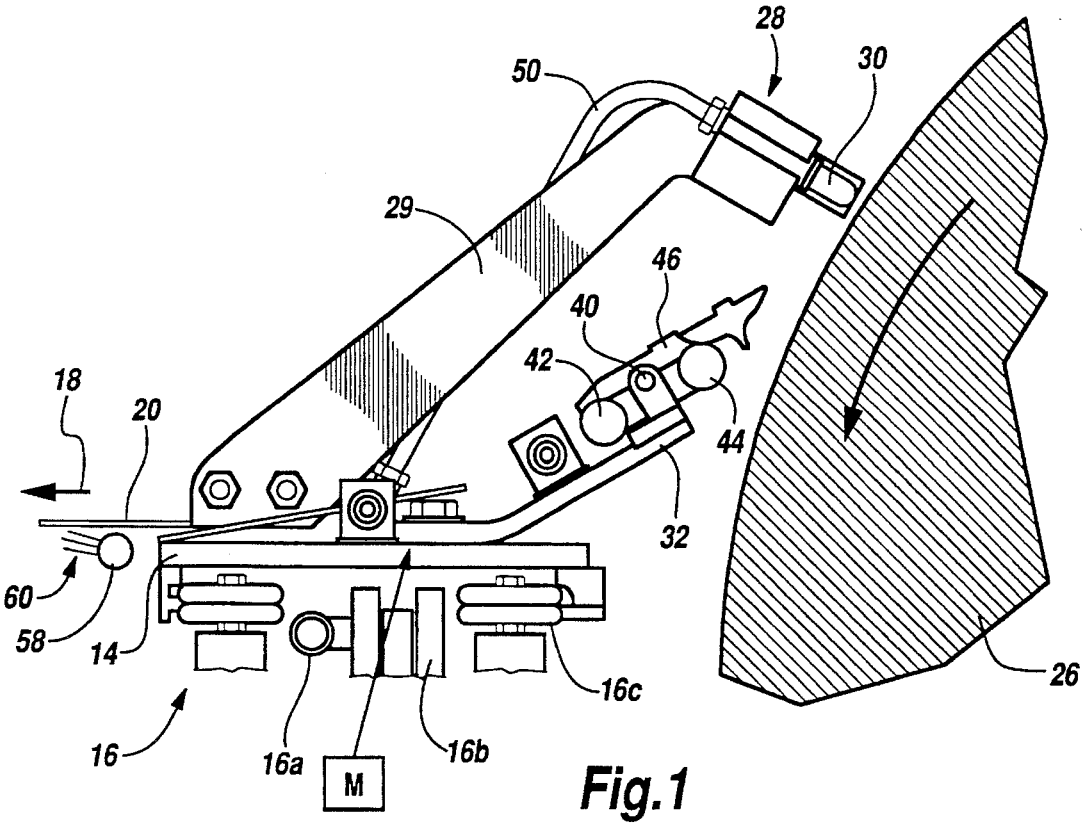
FIG. 1 is a side-elevational view of the transport apparatus showing the water jet nozzle and the doctor blade.
Figure 2:
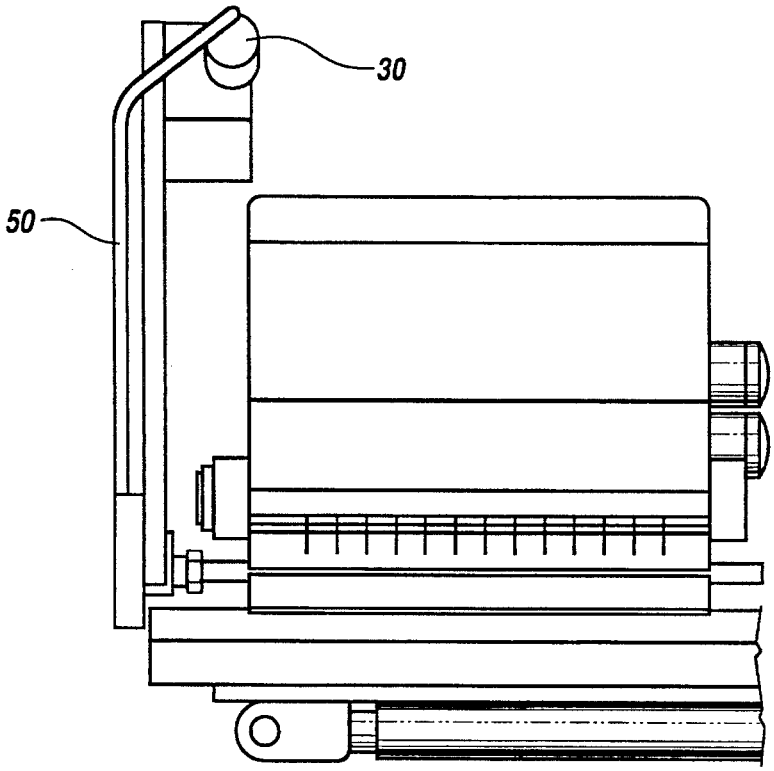
FIG. 2 is a front-elevational view of the apparatus shown in FIG. 1, and illustrating the water jet nozzle disposed in its ready position outboard of the tail and over the support roll.
Figure 3:
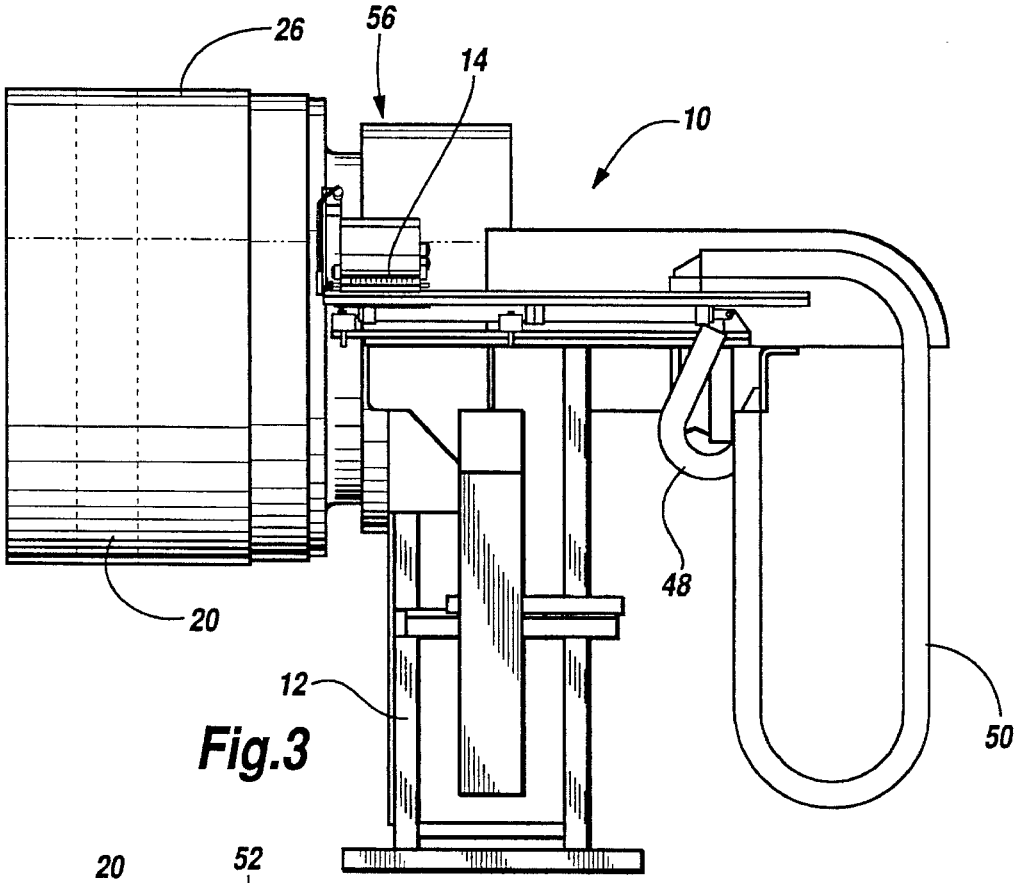
FIG. 3 is a front-elevational view which illustrates the transport apparatus in its storage position.

With reference to FIGS. 1 and 3, a transport apparatus, generally designated with the number 10, is mounted on a pedestal 12 and includes a platform 14. The platform 14 is, in turn, mounted for sliding motion on slide apparatus 16, which includes rollers 16*a*, 16*c* and slide 16*b*. This sliding apparatus and platform motion extend transversely of the direction of travel 18 of the web tail 20 in the papermaking machine, as shown by the directional arrow 22 in FIG. 5. This transverse movement is then in a co-axial direction with the axis of rotation 24 (FIG. 4) of the support roll 26, such as a calender roll in a papermaking machine. The transverse movement is reciprocal and the platform movement is provided by a motor 17 as shown somewhat schematically in FIG. 1.

In this apparatus, a water jet, generally designated 28, having a nozzle 30 is mounted on the platform 14 with an arm 29. Similarly, a doctor 32 having a doctor blade 34 with a leading edge 36 and a side edge 37 (FIG. 6) is also mounted on platform 14 to move with the water jet and nozzle transversely of the roll 26.

The doctor is pivotally mounted to a plate 46 about pin 40. The doctor apparatus includes a pair of laterally extending air tubes 42, 44 mounted on either side of the pivot 40 between the doctor plate 46 on which the doctor blade 34 is mounted. By pressurizing one air tube and relieving the air pressure in the other air tube, the doctor can be pivoted between an engaged position where the leading edge 36 of the blade engages the surface of the support roll 26, and a disengaged position, where the leading edge of the doctor blade is spaced above the surface of the support roll.

Mounted to the platform, and extending between sources of compressed air 43 and water 31 are flexible tubes 48, 50 which link the nozzle 30 of the water jet and the actuation tubes 42, 44 of the doctor, respectively, with sources of pressurized water 31 and air 43, so that the water jet can be activated to direct a high pressure stream of water 33 from the nozzle onto the tail while the tail is supported on the surface of the support roll, and the source of compressed air 43 can be selectively connected and disconnected to the air tubes in the doctor to selectively load and unload the blade from engagement with the web tail on the support roll.

Figure 4:
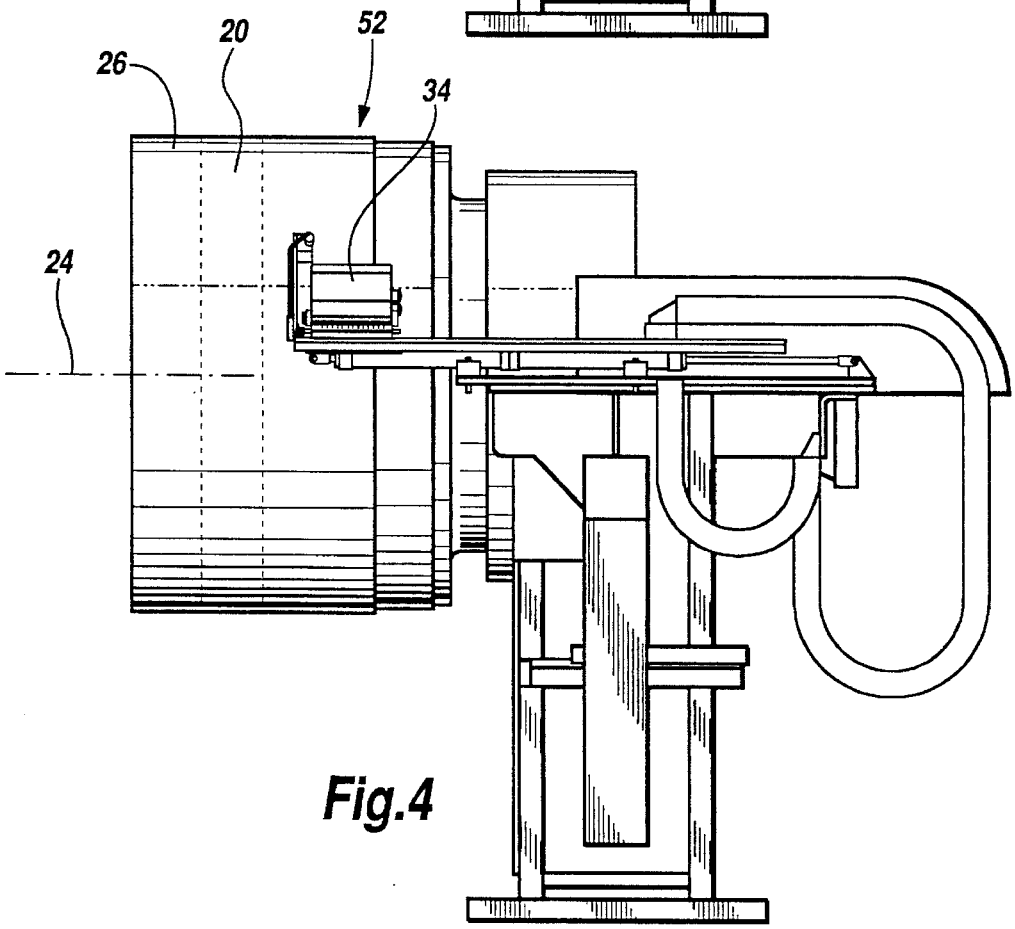
FIG. 4 is a front-elevational view of the transport apparatus in its ready position.
Figure 5:
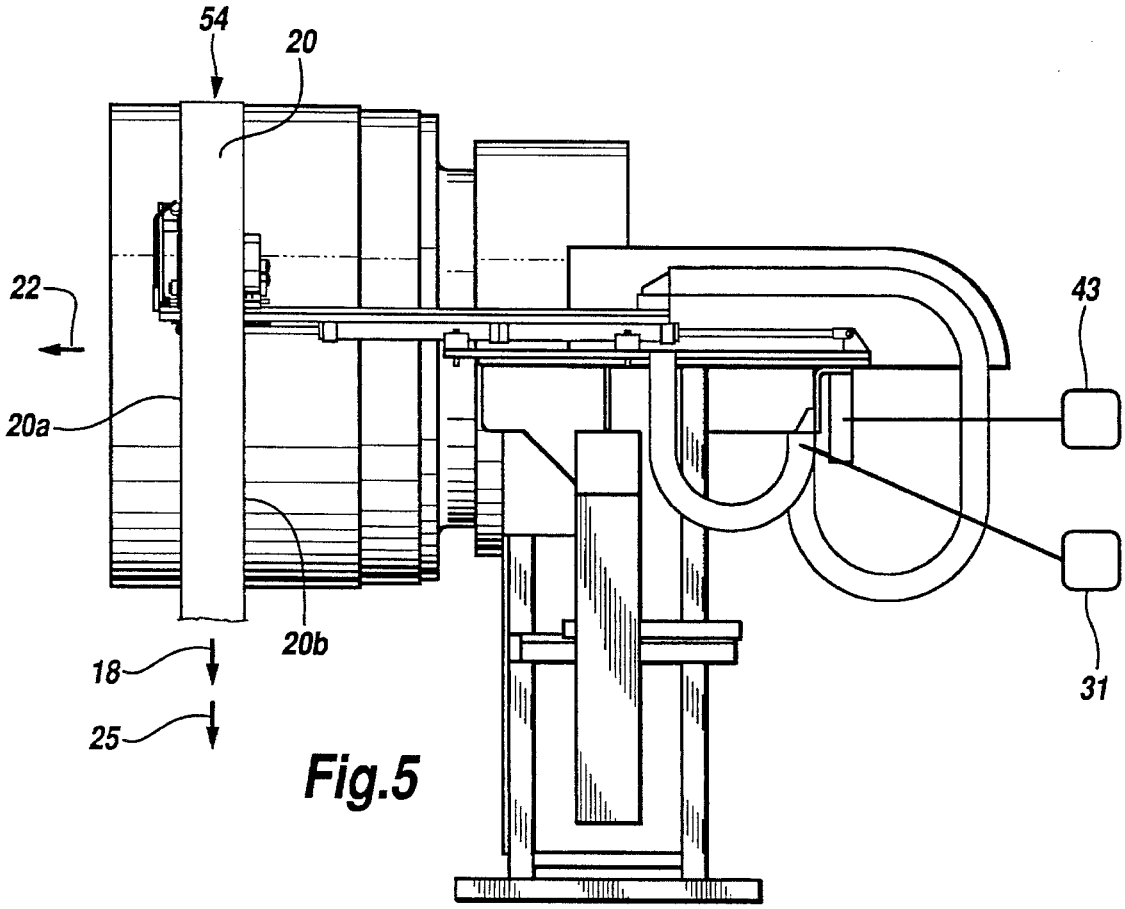
FIG. 5 is a front-elevational view of the transport apparatus in its threading position.

The transport apparatus 10 reciprocates between a ready position, generally designated with numeral 52, as shown in FIG. 4, and a threading position, generally designated by the numeral 54 as shown in FIG. 5. There is a third position, the storage position, which is generally designated with the numeral 56 as shown in FIG. 3. If desired, the transport apparatus can reciprocate between the storage position and the threading position. By way of orientation, the storage position can be designated as being outboard of the ready position. That is to say, the storage position is axially, or laterally, outside of the face, or surface, of support roll 26 toward the roll support, such as bearings.

In the storage position 56, the transport apparatus is positioned axially outboard (i.e. laterally outwardly) with the water jet nozzle and doctor blade outwardly beyond the support roll surface.

In the ready position 52, the transport apparatus has moved the water jet nozzle and doctor blade inwardly to a location over the surface of the support roll surface. This location is near the edge of the support roll surface and is axially outwardly to the location where the web tail is supported on the roll surface.

In the threading position 54, the transport apparatus has positioned the doctor in the path of the web tail so that the doctor blade can be positioned to intercept, lift and deflect the tail from the support roll surface. The water jet is then located such that the nozzle is axially inwardly of the web tail so that the water stream has passed over and beyond the width of the web tail as the transport apparatus has moved to the threading position from the ready position.

The tail 20 typically has a width of from about 6 inches to 10 inches, as defined by its two, parallel, outer edges 20*a*, 20*b*.

In typical practice, the tail is produced in the forming section of the papermaking machine, but it can be produced at other locations upstream of the support roll 26, which preferably is a dryer or calender roll in a papermaking machine. Regardless of where the tail is formed, it is usually formed in an outside portion of the width of the eventual full sheet as formed on the papermaking machine. Thus, with reference to FIG. 5, the web 20 is shown supported near an end of the support roll 26.

Figure 6:
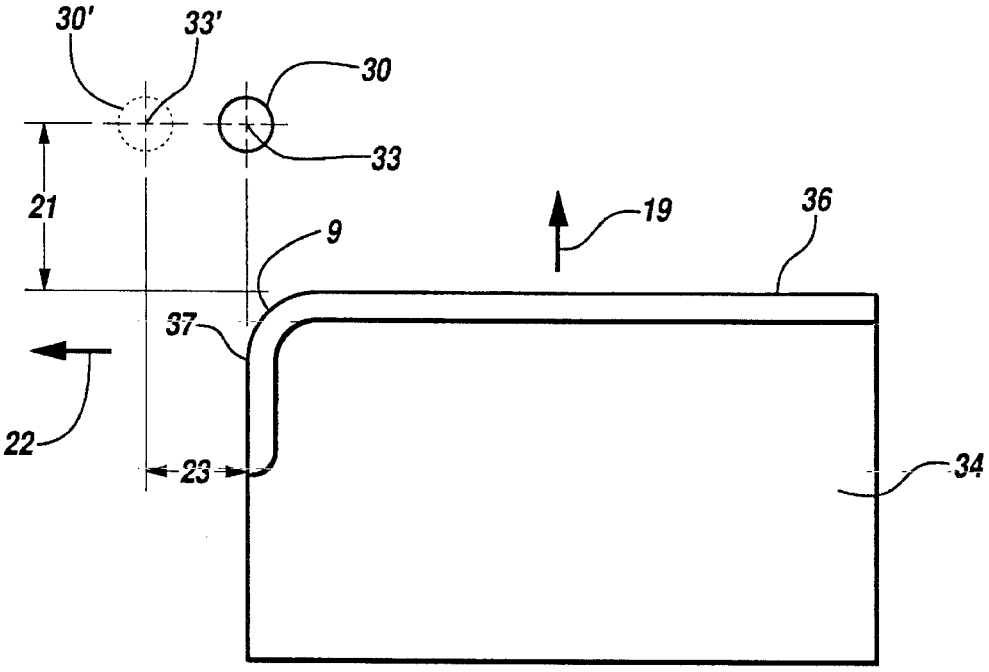
FIG. 6 is a plan view, in somewhat schematic format, showing the relative locations of the point where the water jet impinges the tail, and the doctor blade.

With reference to FIG. 6, the doctor blade 34 has both a leading edge 36 and a side edge 37, both beveled. The leading edge presents a knife-like edge extending upstream relative to the direction of tail travel 18. The beveled side edge 37 is designed to smoothly engage the edge of the tail to initially produce a thread-like, secondary tail during the initial stages of the tail clip producing process. The smooth engagement is facilitated by the curved corner 9 between the leading and side edges. The initial width of the string-like, secondary tail is only fractions of an inch before the tail clip is effected for the entire width of the tail.

With further reference to FIG. 6, the location of the nozzle and/or point of impingement of the pressurized water stream 30, 30$^1$, 33, 33$^1$ is upstream in the direction of arrow 19 of the leading edge of the doctor blade. This upstream distance 21 preferably ranges from about 1 inch to about 6 inches. In addition, the location of the nozzle and/or the point of impingement of the water stream 30, 30[1], 33, 33[1] against the support roll surface laterally relative to the side edge 37 of the doctor blade ranges from about being in-line, or coincident, with the extension of the side edge 37 of the doctor blade, to about 0.5 inch laterally outwardly from the side edge 37 in the transverse direction 22. This outward distance is designated with the numeral 23. Conversely, this distance 23 extends inwardly relative to the end of the roll and the ready position of the transport apparatus (FIG. 4). In either case, the location of the impingement of the water stream is preferably laterally outside of the edge of the tail on the support roll surface, but no closer than over the edge of the tail (i.e. coincident) at the position where the traversing motion of the transport apparatus starts. The edge of the tail would then be located from between a line coincident with an extension of the side edge 37 of the doctor blade to a position laterally outwardly from the side edge 37 of the doctor blade. Since the nozzle of the water jet and the doctor are both mounted on the transport apparatus, essentially, fixedly, the ready positions of the nozzle and doctor blade are predetermined relative to one another.

As shown in FIG. 1, downstream of the doctor 32 is a pipe 58 which extends in the cross machine direction beneath the intended path of travel of the tail as it is deflected by the doctor blade 34. This pipe is connected to a source of pressurized air (not shown) and is perforated on the downstream side, so as to constitute an air shower for projecting a stream of pressurized air, designated with the numeral 60, downstream in the direction of arrow 18 to support, direct, urge and convey the tail downstream to other apparatus on the papermaking machine, such as the reel.

After the tail has been threaded into the next downstream apparatus, such as the reel, that apparatus creates tension in the tail, which is designated with the numeral 25 in FIG. 5, which functions to pull the tail away from its support on the surface of roll 26. At this point, the doctor blade is no longer needed to doctor (i.e. scrape) and deflect the tail from the surface of support roll 26.

In operation, the transport apparatus on which the doctor and water jet are mounted is positioned in its storage position. A paper web tail is produced on the papermaking machine at some upstream location, and is brought into supporting engagement with the rotating surface of the support roll.

When the tail is running in a stable condition, the transport apparatus is brought into its ready position. The doctor blade is loaded (activated) with the leading edge of its blade against the support roll surface. The water jet is activated and its nozzle directs a pressurized stream of water against the support roll surface. Activation of the water jet and the doctor blade against the support roll surface is substantially simultaneous, and either one of these activating events could occur slightly before the other within the scope of the invention.

The transport apparatus is then moved laterally inwardly from its ready position into its threading position. As this movement commences, the impinging water stream initially cuts a string-like, secondary tail in the tail supported on the rotating roll surface. As this secondary tail is produced, it is substantially, simultaneously intercepted advantageously by the beveled side edge of the doctor blade and lifted and deflected from the surface of the support roll. Use of the beveled side edge of the doctor blade is not considered absolutely necessary, but its use provides for a smoother operation, as does the curved corner 9 between the leading and side edges. The string-like, secondary tail is quickly widened as the water jet and doctor blade are moved transversely across the face of the support roll, and the width of the tail, to the end of the threading position, where the blade halts its traversing movement and the entire tail is intercepted by the leading edge of the doctor blade and lifted and deflected away from the support roll. The process of creating the secondary tail and continuing to laterally sever the on-coming tail constitutes the clipped tail operation.

The threading position, therefore, has both moving and stationary elements and extends from the outer edge of the tail on the initial side to be severed to the other edge of the tail.

When the water jet has traversed the width of the tail, it is deactivated such that the high pressure water stream is stopped from impinging the surface of its support roll. When the tail is lifted from the surface of the support roll by the doctor blade, the air shower downstream of the doctor intercepts it and urges it downstream into engagement with the next station on the papermaking machine, such as a reel. As the tail is engaged by the downstream apparatus, tension is created in the tail and the tension lifts the tail from the surface of the support roll, and the tail is guided downstream into the next apparatus without assistance of the tail clip apparatus.

At this point, the doctor is deactivated and its blade pivoted out of its engagement with the surface of a support roll. When the pressurized water stream is stopped and the doctor blade has been pivoted out of its engagement with the roll surface, the process cycle has effectively been completed from an operational standpoint, although it is better to continue and return the transport apparatus to its original starting position, such as the ready or storage positions. The tail is widened by whatever apparatus is producing the tail upstream of the support roll, so as to create a full width sheet of paper web. At either the time when the tail is tensioned and pulled off its support on the support roll without requiring the doctor blade to lift it from the support roll surface (preferred) or when the tail has been widened to the full-width of the production sheet of the paper web, the transport apparatus is reciprocally traversed back to its ready (preferred) or storage positions. In either the ready or storage positions, the water jet and doctor are not activated until it is desired to thread the machine again when the paper sheet has broken and a new tail is created upstream of this apparatus.

This method, apparatus and process for producing a clipped tail is automatic in that it is done with the nozzle/water jet and doctor blade operating together without manual assistance by an operator.

Naturally, some variation can be made in the method and apparatus of this invention without departing from the spirit and scope of the invention and claims. Some of these variations or changes have been described above. Other contemplated variations include not returning the transport apparatus reciprocally to the ready position at the end of the roll when the tail has been transferred and the sheet widened to full width, but instead leaving the transport apparatus in the threading position or traversing the transport apparatus for the complete width of the papermaking machine and stop it at a ready position on the other side of the papermaking machine. In such a case, the complete reciprocating cycle to the initial ready position on one end of the support roll would be for every two tails to be threaded instead of each tail.

Also contemplated is returning the transport apparatus to the storage position instead of the ready position in its reciprocal movement back from the threading position.

We claim:

1. A method for automatically producing a clipped tail in a traveling tail of a web as the tail is supported on a co-traveling roll support surface, and to lift and deflect the traveling tail from the roll surface, the tail having spaced, parallel outer edges, comprising the steps of:

1) positioning a doctor over the traveling roll surface from a at a doctor ready position at a location outside of one of the edges of the tail, the doctor having a blade with a leading edge;

2) positioning the nozzle of a water jet in a nozzle ready position at a predetermined location upstream of the doctor blade, relative to the direction of tail travel, and outside of the said one edge of the tail over the roll surface, said doctor and said water jet nozzle both being mounted and fixedly located relative to one another on a platform, said platform being mounted on a transport apparatus for reciprocal traversing movement in a direction parallel with the axis of rotation of the roll between ready and threading positions relative to the roll support surface;

3) engaging the traveling roll surface with the leading edge of the doctor blade, at its ready position outside of the said one of the edges of the tail;

4) impinging a web-severing water stream against the roll support surface at a location on the tail or laterally outside the said one edge of the tail and upstream of the leading edge of the doctor blade;

5) traversing the water jet and doctor blade together on the platform in the predetermined locations relative to each other over the width of the tail transversely of the direction of tail travel to intercept the tail, so as to automatically sever the tail with the water stream to produce a clipped tail, and to simultaneously lift and deflect the traveling clipped tail with the doctor blade away from the supporting roll surface;

6) deactivating the water jet to stop the water stream from being emitted from the water jet nozzle; and 7) disengaging the doctor from web tail deflection engagement.

2. A method for producing a clipped tail as set forth in claim 1, further including the step of:

projecting an air shower in association with the doctor blade, and downstream thereof, so as to urge the clipped and deflected tail downstream.

3. A method for producing a clipped tail as set forth in claim 1, wherein:

the doctor blade additionally has a side edge on the side facing the tail when the doctor is in its ready position, and both the leading and side edges are beveled for facilitating engagement of the web tail.

4. A method for producing a clipped tail as set forth in claim 1, further including the step of:

tensioning the traveling tail between the roll support surface and a downstream apparatus before disengaging the doctor blade from web tail deflection engagement.

5. A method for producing a clipped tail as set forth in claim 3, wherein:

the location of the point of impingement of the water jet against the support roll surface relative to the said side edge of the doctor blade is from between about coincident with the said side edge of the doctor blade to about 0.5 inches laterally outwardly of the said edge of the doctor blade.

6. A method for producing a clipped tail as set forth in claim 1, wherein:

the location of the point of impingement of the water jet upstream of the leading edge of the doctor blade against the support roll surface is a distance from about one inch to about six inches.

7. A method for producing a clipped tail as set forth in claim 1, further including the step of:

returning the nozzle and doctor to their ready positions or to storage positions after deactivating the water jet and disengaging the doctor.

8. Apparatus for automatically producing a clipped tail in a traveling tail of a web as the tail is supported on a co-traveling surface of a rotatable support roll, and to lift and deflect the traveling tail from the roll surface, the tail having spaced, parallel outer edges comprising, in combination:

a transport apparatus having a platform, the platform mounted so as to be positioned and arranged for reciprocal traversing movement in a direction parallel with the axis of rotation of the support roll between ready and threading positions;

a water jet having a nozzle, for projecting a tail-severing stream of pressurized water against the surface or the roll, mounted to the platform;

doctor apparatus having a blade with a leading edge, and blade loading means, mounted to the platform for selectively engaging and disengaging the support roll surface with the leading edge of the blade to lift and deflect the tail from the support roll surface, the water jet and the doctor blade being fixedly located relative to one another at predetermined locations on the platform and such that the water jet nozzle is located upstream of the doctor blade;

motor means operatively associated with the transport apparatus and platform for reciprocally moving the platform between the ready and threading positions relative to the support roll surface;

whereby the water jet nozzle and doctor blade are structured and arranged to be substantially simultaneously activated to cooperate to move together transversely from a ready position of the platform to engage the traveling tail to automatically sever the tail to produce a clipped tail and to lift and deflect the tail from the support roll as the platform is moved to transport the doctor blade and water jet nozzle between the ready and threading positions.

9. Apparatus for producing a clipped tail as set forth in claim 8, further comprising:

an air shower means for producing a stream of air directed downstream of the doctor blade to urge the tail downstream of the apparatus.

10. Apparatus for producing a clipped tail as set forth in claim 8, wherein:

the doctor blade additionally includes a side edge disposed to engage an outer edge of the tail over the roll surface as the blade is moved laterally inwardly between the ready and threading positions on the support roll surface.

* * * * *